United States Patent [19]

Hurrell

[11] Patent Number: 4,921,366

[45] Date of Patent: May 1, 1990

[54] COSMETIC CONTAINER WITH ENGAGING RIB STRUCTURE

[75] Inventor: Edward T. Hurrell, Huntington, N.Y.

[73] Assignee: Henlopen Manufacturing Co., Inc., Melville, N.Y.

[21] Appl. No.: 306,249

[22] Filed: Feb. 2, 1989

Related U.S. Application Data

[63] Continuation of Ser. No. 52,462, May 20, 1987, abandoned.

[30] Foreign Application Priority Data

May 20, 1986 [GB] United Kingdom ..... 8612276

[51] Int. Cl.[5] ..... A46B 11/00; A45D 40/00

[52] U.S. Cl. ..... 401/126; 401/68; 401/78; 401/122; 401/129; 401/194; 220/404; 220/462

[58] Field of Search ..... 401/122, 128, 194, 130, 401/78, 129, 75, 68, 126; 206/523; 220/404, 410, 462, 468

[56] References Cited

U.S. PATENT DOCUMENTS

| | | | |
|---|---|---|---|
| 2,076,549 | 4/1937 | Conner | 215/6 |
| 2,236,683 | 4/1941 | Gudge | 401/194 X |
| 2,291,379 | 7/1942 | D'Alelio | 215/1 |
| 2,781,741 | 2/1957 | Tintner | 401/194 X |
| 3,039,648 | 6/1962 | Busch | 220/462 |
| 3,124,244 | 3/1964 | Hopgood | 401/78 |
| 3,285,461 | 11/1966 | Santelli | 220/404 |
| 3,547,550 | 12/1970 | Gruska | 401/78 |
| 3,706,354 | 12/1972 | Gruska | 401/78 |
| 3,817,636 | 6/1974 | Ritzenhoff | 401/78 |
| 3,826,358 | 7/1974 | Butler et al. | 206/523 X |
| 3,870,186 | 3/1975 | Reinhard | 220/212 |
| 3,883,254 | 5/1975 | Vasas | 401/129 X |
| 3,940,052 | 2/1976 | McHugh | 220/404 |
| 4,696,840 | 9/1987 | McCullough et al. | 220/462 |

FOREIGN PATENT DOCUMENTS

| | | | |
|---|---|---|---|
| 1932002 | 1/1971 | Fed. Rep. of Germany . | |
| 2939664 | 4/1981 | Fed. Rep. of Germany . | |
| 235169 | 3/1945 | Switzerland | 401/129 |
| 1276859 | 6/1972 | United Kingdom . | |

*Primary Examiner*—Steven A. Bratlie

*Attorney, Agent, or Firm*—Kane, Dalsimer, Sullivan, Kurucz, Levy, Eisele and Richard

[57] ABSTRACT

A container for a cosmetic preparation such as mascara, lip gloss, etc., including a tubular inner plastic container and an outer metal shell which substantially encloses, and is substantially immovably fixed to, the inner container. The metal shell can serve to inhibit escape of vapor from the cosmetic solvent through the container wall. For improved integrity of the container, the inner surface of the metal shell can be formed with a set of circumferentially spaced, axially extending ribs which bite into the plastic of the inner container, when the container is assembled by pushing the shell onto the inner container, to form grooves in which the ribs engage tightly. An aperture can be formed in the outer shell for displaying to the user the color of the contained cosmetic preparation.

11 Claims, 4 Drawing Sheets

FIG. 3.
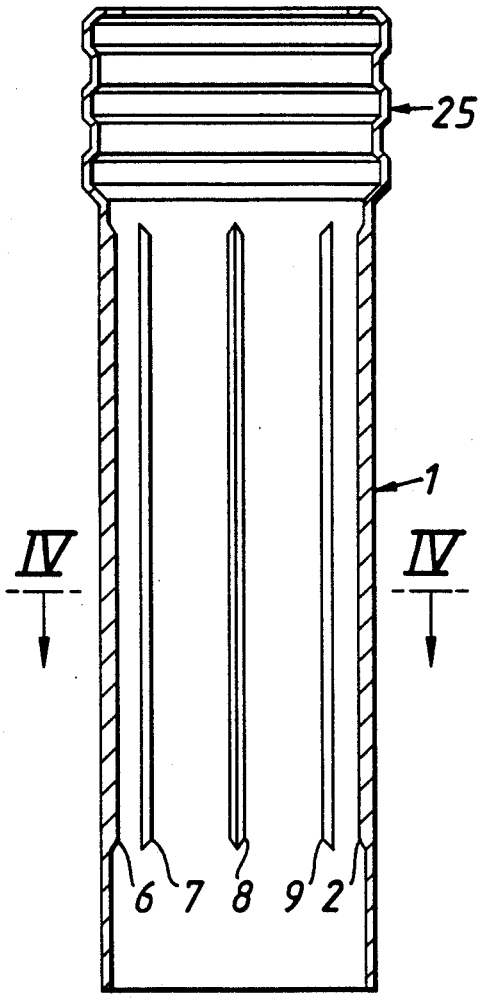
FIG. 5.
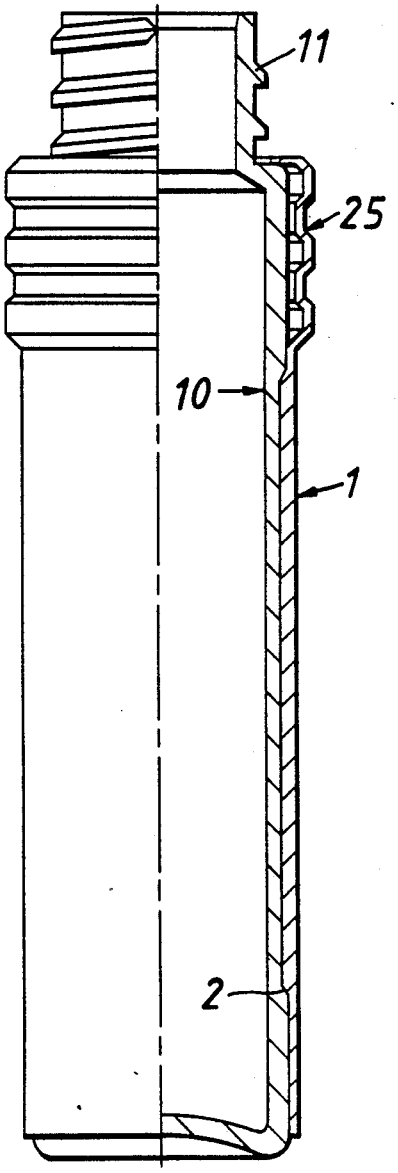
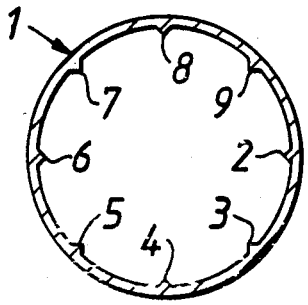
FIG. 4.

52
63
50
62
51

59

53
63
60
54
58
62
W
55
61'
61
61''
56
57

COSMETIC CONTAINER WITH ENGAGING RIB STRUCTURE

This is a continuation of co-pending application Ser. No. 052,462 filed on May 20, 1987 now abandoned.

BACKGROUND OF THE INVENTION

The present invention relates to containers for cosmetic preparations and to cosmetic products incorporating such containers. The invention relates particularly but not exclusively to containers for facial colouring materials, such as mascara, lipgloss, lipstick, and the like. Such cases were originally made completely of metal. These cases had various draw-backs, notably:

- internal corrosion by the cosmetic product
- high cost of materials and assembly
- difficulties in achieving adequate air tight and liquid-tight metal-to-metal joints
- metal fines and shred occasionally present in the cosmetic product
- expensive and difficult to color and to decorate.

Injection molded and blow molded plastic containers were subsequently introduced in order to resolve the above problems and are now widely used.

However the use of plastic containers has given rise to manufacturing problems. In particular, the material of the container has had to be carefully chosen according to the cosmetic preparation. For example, cosmetic preparations, such as make-up, mascara and lipgloss, which are water-based require a container made of polyolefin resin whereas other cosmetic products incorporating a hydrocarbon base require a PVC or other special resin container. The reason for this is that if such a PVC or other resin container is used for an aqueous cosmetic product or a polyolefin resin container is used for a hydrocarbon-based cosmetic product, then the vapor of the base is liable to permeate through the container, leading to drying and hardening of the product. Even if the optimum plastic is chosen for the particular cosmetic preparation used, eventually some of the base is liable to permeate through the container walls and accordingly the shelf life of the product is limited. Because PVC and polyolefin resins have different cooling characteristics, resulting in different degrees of shrinkage upon solidification and cooling during the molding process, different molds are required for making identically dimensioned containers from these materials, with the disadvantages of the attendant cost and inflexibility of the different molds.

Also, while the plastic containers can be made more economically than all-metal containers, they do not have the "quality" feel, weight and appearance of the latter.

OBJECT OF THE INVENTION

Accordingly it is an object of the present invention to provide a container for cosmetic preparations which avoids at least some of the problems referred to above.

SUMMARY OF THE INVENTION

According to one aspect of the invention a container for a cosmetic preparation incorporating a volatile base comprises an inner container of plastic material and a metal outer shell which encloses the inner container substantially completely so as to form a barrier substantially to inhibit vapor of the base from escaping through the container wall.

This allows a wider choice of materials to be used for the inner container, and in particular it permits use of a plastic in a container for a given preparation, which is permeable to vapor of the base of that preparation and thus avoids the additional cost of different molds for a variety of materials.

It should be understood that as used herein, the term "volatile base" includes any material which can evaporate to cause the product to deteriorate, e.g. by thickening, hardening or, where the base is used as a particle binder in a cosmetics stick, by disintegrating.

According to a second aspect of the invention a cosmetics container comprises an inner container of plastic material and a generally tubular metal outer shell which incorporates on its inner surface at least one projection in engagement with the outer surface of said inner container.

The metal outer shell is preferably formed on its inner surface with a plurality of circumferentially spaced inwardly projecting ribs which extend axially of the shell. These ribs engage tightly in grooves which they form in the outer surface of the inner container as the shell is pushed axially onto it during assembly.

In a further aspect, the present invention addresses a problem relating to the packaging of cosmetic products. Again, the particular example considered here is mascara and it should be mentioned that a recent noted market trend is the emergence of mascara as a color product, as against the traditional color limitation of mascara to black, brown or navy blue. This trend calls for product visibility on display, both to attract and to facilitate user choice. Once again, however, there is a trend toward cosmetic packaging having quality "weight" and "feel", and this leads to the need to use metal as a material in the cosmetic casing. Color display, which can most readily be achieved using transparent or colored plastics in the casing, and the "feel" of the product are therefore conflicting requirements.

In this third aspect, the present invention seeks to alleviate this problem and to that end provides a container for a cosmetic preparation comprising an inner container of plastic material and a metal outer shell which encloses the inner container, said metal outer shell being formed with an aperture through which the color of the cosmetic preparation can be displayed to the user.

The inner container may be transparent or appropriately colored at least at the position of the aperture. If the container is transparent it is the colour of the cosmetic preparation itself which is visible from the outside through the window.

In a disclosed arrangement the inner container is formed with a raised window portion which fits inside the aperture and projects at least partly through the thickness of the aperture. In this arrangement, the shell is tubular and closed at one end, the aperture comprising a slot which extends axially from the other, open end, so that the container can be assembled by sliding the inner container into the shell from its open end and aligning the raised window with the slot so that the former slides into the latter. The inner plastic container is formed with a neck which projects from the open end of the shell and an annular ferrule fits tightly over the open end of the shell to close off the end of the slot.

The cosmetic container in accordance with any of these aspects of the invention may for example be a bottle provided with a screw cap, the bottle being gripped within the metal outer shell.

The invention includes within its scope cosmetic products incorporating containers in accordance with any or all aspects of the invention.

BRIEF DESCRIPTION OF THE DRAWINGS

Four embodiments of the invention will now be described by way of example only with reference to FIGS. 1-9 of the accompanying drawings, wherein:

FIG. 3 is a longitudinal cross-section of a metal shell for another container in accordance with the invention;

FIG. 4 is a section taken on IV—IV of FIG. 3;

FIG. 5 is an elevation, partly in section, illustrating a cosmetic container incorporating the metal shell of FIGS. 3 and 4;

DESCRIPTION OF THE PREFERRED EMBODIMENTS

Figure 1:
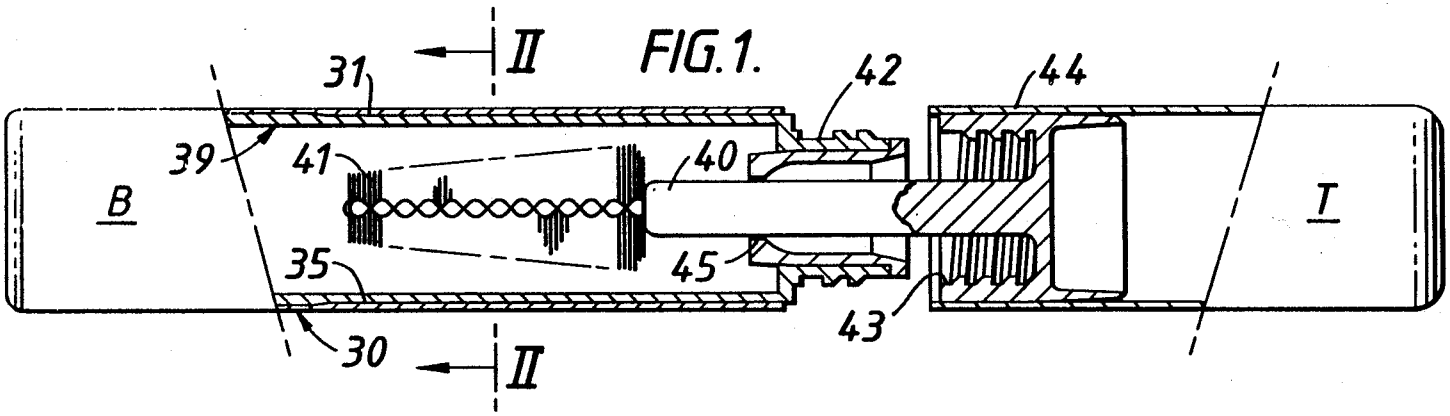
FIG. 1 is an elevation, partially in section of a mascara container in accordance with the invention.
Figure 2:
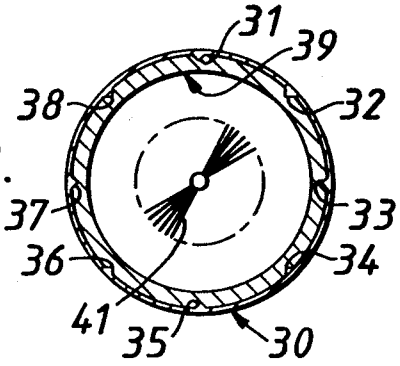
FIG. 2 is an axial section taken on II—II of FIG. 1.

FIGS. 1 and 2 show a mascara bottle comprising a body B and a top T, the top T carrying a stem 40 which in turn carries a brush 41. The body B comprises an internal plastic molding 39 which is enclosed within a cylindrical metal shell 30. Top T is similarly fitted within an outer metal shell 44. Molding 39 incorporates a screw neck 42 onto which a correspondingly screwed portion 43 of top T can be screwed. When the two parts are screwed together in this fashion, mascara within body B is enclosed substantially completely by metal shells 30 and 44, in accordance with the invention. When top T is unscrewed from body B, the stem 40 and brush 41 can be withdrawn through a hole 45 in a wiper insert disposed in the neck 42 to enable mascara to be applied.

In accordance with another aspect of the invention, metal shell 30 incorporates eight longitudinally extending splines 31 to 38 which are regularly spaced about its inner circumference, as is best seen in FIG. 2. These splines bite into molding 39 and prevent shell 30 from twisting relative to molding 39 when the two parts of the mascara bottle are screwed or unscrewed. The top T may incorporate a similar arrangement of splines (not shown).

The shell 1 shown in FIG. 3 is of generally tubular form and as shown in FIG. 5 is fitted over a plastic bottle 10. It incorporates a corrugated portion 25. As shown in FIG. 4, the shell 1 incorporates eight inwardly projecting splines 2 to 9 radially distributed about its inner surface. These splines extend axially along a substantial part of the length of the shell and bite into the outer surface of the inner container 10, as can be seen with reference to the spline 2 shown in FIG. 3. Accordingly, a screw cap (not shown) can be unscrewed from the neck 11 of the bottle without slippage occurring between the shell 1 and the bottle 10. Because the splines 2 to 9 extend in the axial direction, the shell 1 can be fitted over the bottle 10 without difficulty. The shell 1 may suitably be formed from hard aluminium sheet of 25 micron thickness by pressing the sheet into a suitable shaped dye in a multi-stage process. Alternatively, the internally splined shell may be formed by an impact extrusion process for example.

Figure 6:
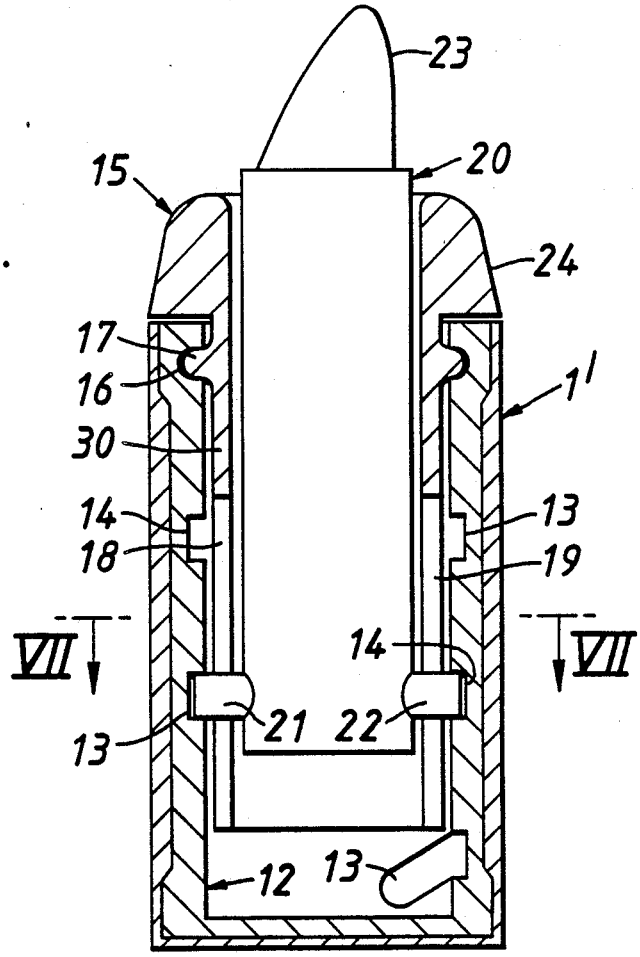
FIG. 6 is a longitudinal cross-section of a lipstick applicator in accordance with the invention.
Figure 7:
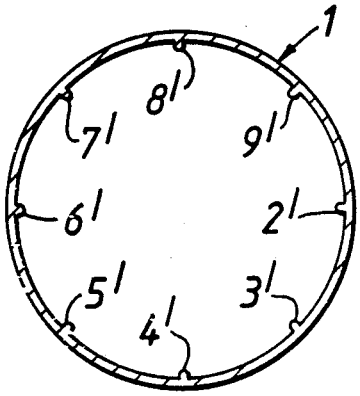
FIG. 7 is a section through the outer shell taken on VII—VII of FIG. 6.

FIGS. 6 and 7 illustrate an applicator in accordance with both aspects of the invention. A metal shell 1' incorporates eight axially extending internal splines 2'-9' (FIG. 7) similar to those shown in FIG. 2; however, in this case the base of the metal shell is closed. The shell 1' is fitted over an internal plastics container 12 and thereby substantially prevents volatile base from a stick of lipstick 23 from permeating through the container. A metal cap (not shown) fits over the surface 24 of a shoulder portion 15 of the applicator when not in use. The lipstick 23 is suported in a holder 20 which incorporates two diametrically opposite projections 21 and 22 which engage respective helical grooves 13 and 14 formed in the inner surface of container. Shoulder portion 15 incorporates a tubular extension 30 which extends between holder 20 and casing 12 and engages projections 21 and 22 by means of respective axially extending slots 18 and 19. Thus when shoulder portion 15 is rotated relative to the body of the container (comprising outer shell 1' and inner container 12) the holder 20 rotates with it and gradually extends as the projections 21 and 22 ride within the helical grooves 13 and 14. The shoulder portion 15 is axially located within container 12 by means of an annular projection 17 which fits within a corresponding annular recess 16 in the container 12.

It will be appreciated that when a metal cap is fitted over surface 24 of shoulder portion 15, the lipstick 23 is substantially completely enclosed in metal and that escape of vapor from its volatile base is thereby substantially prevented.

Figure 8:
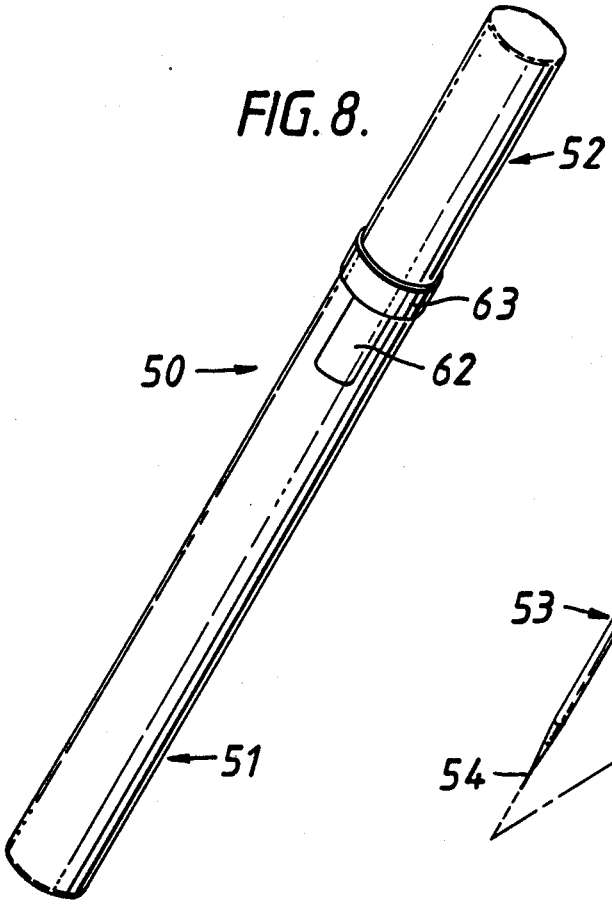
FIG. 8 is a perspective view of another mascara container and applicator package according to the invention.
Figure 9:
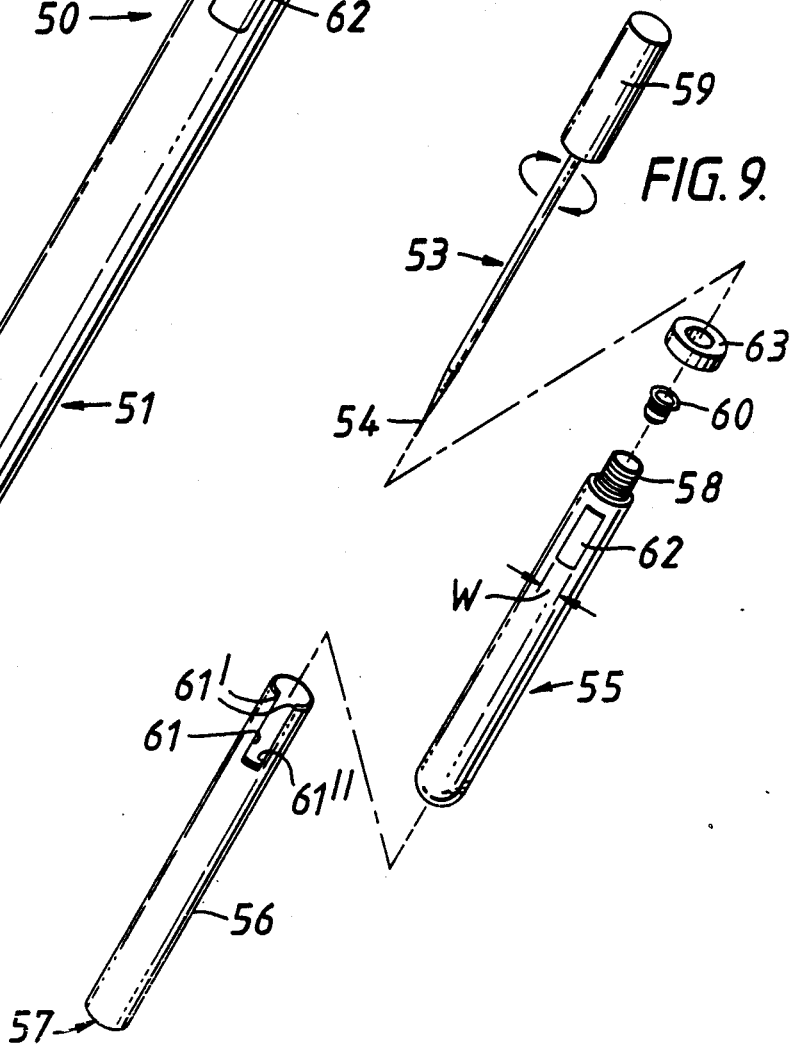
FIG. 9 is an exploded perspective view of the package shown in FIG. 8.

FIGS. 8 and 9 show a mascara package in accordance with at least the first and third aspect of the invention. The package 50 comprises a container body 51 for containing a quantity of colored cosmetic product and a cap 52 for closing the container body 51, the cap having an elongate applicator 53 for the product. This applicator projects axially into body 51 when the cap is attached to the body, and is formed, in this case, with a fine bristle brush 54 for application of the cosmetic product.

As in the first embodiment the container body 51 comprises an inner tubular container 55 molded from a plastic material, enclosed within a cylindrical metal shell 56 which is closed at its base end 57. The inner container has a screw neck 58, and the cap 52 has an internal plastics part which is integral with the shaft of the applicator 53 and which includes an internally threaded portion which can be screwed onto the neck 58. The cap also has a tubular outer metal shell 59 which may match in finish and diameter the shell 56 of the body 51.

A wiper insert 60 is fitted within the neck 58 and includes a flexible central portion defining a wiping orifice through which the applicator shaft and brush enter and exit the container.

The metal shell 56 is formed with an aperture which comprises a short axial slot 61 extending from the rim of the open end of the shell. The wall of the plastic inner container 55 is formed with a corresponding raised portion 62 which is the same width W as the slot, and which is preferably of substantially the same thickness as that of the wall of the shell 56.

To assemble the package, the inner container 55 is pushed into the shell 56 with the slot 61 and the raised portion 62 axially aligned. When the container 55 is fully inserted, the portion 62 is fully located within the slot with its outer surface substantially flush with the adjacent surface of the shell wall. Finally, a metal annular ferrule 63 is fitted onto the end of the shell 56 so as to protect the user from the sharp corners 61' where the slot opens on the rim of the open end of the shell, to lock the assembly of the container 55 and shell 56 together and to provide a neat finish.

The container 55 may be made of transparent plastic so that the colour of the contained cosmetic product can be seen through the raised portion 62, which thus constitutes a window. Alternatively, a coloured plastic material of the same color as the cosmetic product may be employed, or the raised portion may be painted with appropriately color paint. Although it is not essential that the part of the inner container exposed through the aperture 61 should be raised, this is preferable as it protects the user from the sharp cut-out edge 61'' of the aperture 61.

The raised portion 62 and its corresponding aperture 61 can be of any size and shape. For example, instead of being rectangular as in the embodiment of FIGS. 8 and 9, they may be semicircular.

The internal surface of the shell 56 may be longitudinally splined as in the previous embodiments so as to provide a firm grip on the outer surface of the container 55 by grooving of the latter on assembly.

What is claimed is:

1. A cosmetic container comprising a tubular inner container of plastic material and a tubular metal outer shell which is fixed substantially immovably to said tubular inner container, and which is formed on its inner surface with a plurality of circumferentially spaced inwardly projecting ribs which extend axially around the shell, said ribs engaging tightly in corresponding grooves which become formed in the outer surface of the tubular inner container by said ribs when, during assembly, the tubular inner container and the tubular outer metal shell are forced together;

wherein said tubular inner container includes a neck portion which projects outwardly from said metal outer shell, and wherein there is further provided a closure which is engagable with said neck portion for closing the container; and wherein an elongate applicator for applying the cosmetic preparation is attached to said closure so as to project into said inner container when said closure is engaged with said neck.

2. A cosmetic container according to claim 1 wherein said tubular metal outer shell is closed at one end, and wherein a neck portion of said tubular inner container projects outwardly of the other end of said metal outer shell.

3. The container of claim 1 wherein said metal outer shell is formed with an aperture through which the color of the cosmetic preparation can be displayed to the user.

4. A container according to claim 3 wherein a portion of the tubular inner container is exposed through said aperture in said metal outer shell.

5. A container according to claim 4 wherein said portion of said tubular inner container is shaped correspondingly to the aperture and is raised so that it projects at least partly through the thickness of said aperture.

6. A container according to claim 5 wherein said metal outer shell comprises a tube which is closed at one end corresponding to the closed end of the tubular inner container, said aperture opening onto the rim at the other end of said tube whereby the container may be assembled by sliding the metal outer shell onto the tubular inner container so that said raised portion of said tubular inner container enters the aperture in an axial direction by way of its opening onto said rim.

7. A container according to claim 6, wherein there is further provided an annular ferrule attached to said open end of said metal outer shell so as to close said opening of said aperture onto said rim, said tubular inner container having a neck portion which projects from said open end of said metal outer shell through said annular ferrule.

8. A container according to claim 4 wherein said portion of the tubular inner container is transparent so that cosmetic preparation within said tubular inner container is visible through said portion.

9. A container according to claim 4 wherein said portion of said tubular inner container is coloured.

10. A container for a cosmetic preparation incorporating a volatile base, comprising:

a tubular inner container of plastic material, said tubular inner container being exposed to said cosmetic preparation or to vapor from said volatile base thereof, and being integrally formed with a base portion which closes one end thereof; and a metal outer shell which is substantially immovably fixed to the tubular inner container and encloses the tubular inner container substantially completely so as to form a barrier substantially to inhibit vapor of the base from escaping through the container wall;

wherein said metal outer shell comprises a tube which is closed at one end corresponding to the closed end of the tubular inner container, and which incorporates on its inner surface at least one circumferentially spaced longitudinal inwardly projecting rib in engagement with the outer surface of said inner container:

wherein said tubular inner container includes a neck portion which projects outwardly from said metal outer shell, and wherein there is further provided a closure which is engagable with said neck portion for closing the container; and wherein an elongate applicator for applying the cosmetic preparation is attached to said closure so as to project into said inner container when said closure is engaged with said neck.

11. A cosmetic container according to claim 10 wherein said ribs engage tightly in corresponding grooves which become formed in the outer surface of the tubular inner container by said ribs when, during assembly, the tubular inner container and the outer metal shell are forced together.

* * * * *